US005275219A

United States Patent [19]

Giacomel

[11] Patent Number: 5,275,219

[45] Date of Patent: Jan. 4, 1994

[54] ENVIRONMENTALLY INTERACTIVE AUTOMATIC CLOSING SYSTEM FOR BLINDS AND OTHER LOUVERED WINDOW COVERINGS

[76] Inventor: Jeffrey A. Giacomel, 2211 Baltic Ave., Arlington, Tex. 76011

[21] Appl. No.: 806,609

[22] Filed: Dec. 12, 1991

[51] Int. Cl.[5] ..... E05F 15/20

[52] U.S. Cl. ..... 160/6; 160/176.1

[58] Field of Search ..... 160/7, 1, 5, 6, 168.1, 160/176.1, 177, 900, DIG.; 49/82.1; 454/224, 258

[56] References Cited

U.S. PATENT DOCUMENTS

| | | | |
|---|---|---|---|
| 3,177,367 | 4/1965 | Brown | 160/5 X |
| 3,436,016 | 4/1969 | Edwards | 454/258 X |
| 3,646,985 | 3/1972 | Klann | 160/168.1 |
| 3,675,023 | 7/1972 | Kunke et al. | 250/833 |
| 3,860,055 | 1/1975 | Wild | 160/1 |
| 4,010,455 | 3/1977 | Stange | 340/224 |
| 4,471,275 | 9/1984 | Comeau | 318/286 |
| 4,497,241 | 2/1985 | Ohkata | 454/258 |
| 4,567,549 | 1/1986 | Lemme | 60/527 X |
| 4,618,804 | 10/1986 | Iwasaki | 318/16 |
| 4,644,990 | 2/1987 | Webb, Sr. et al. | 160/3 |
| 4,700,541 | 10/1987 | Gabriel et al. | 60/528 |
| 4,736,587 | 4/1988 | Suzuki | 60/528 |
| 4,747,887 | 5/1988 | Honma | 148/131 |
| 4,773,733 | 9/1988 | Murphy et al. | 160/5 X |
| 4,864,201 | 9/1989 | Bernot | 318/480 |
| 4,902,953 | 2/1990 | Kraft et al. | 318/663 |
| 4,914,360 | 4/1990 | Haich et al. | 328/16 |
| 4,979,550 | 12/1990 | Long et al. | 160/5 |
| 5,063,984 | 11/1991 | Cherveny | 160/1 X |
| 5,107,916 | 4/1992 | Roermund et al. | 160/6 |
| 5,142,133 | 8/1992 | Kern et al. | 160/5 X |

OTHER PUBLICATIONS

Pethrus Designer Blinds, "Scandinavian Design and Engineering", Date and Place of Publication Unknown.

Louverdrape, "Vertical Blinds for Commercial Installations", pp. 9-13, Date and Place of Publication Unknown.

Comfortex Corporation, "Sunshade Systems for Greenhouses and Skylites", Date and Place of Publication Unknown.

SM Automatic, "Motorization for Interior Window Coverings", 1990, pp. 19-21, 25 and 27, Place of Publication Unknown.

Pethrus Designer Blinds, "Graber Retail Price List Vertical Blinds", Apr. 1, 1990, Place of Publication Unknown.

T. Warem, "Design Principles for Ni-Ti Actuators", pp. 234-244, Date and Place of Publication Unknown.

Author-Unknown, "Electrical Heating of Tinel Wire and Springs", Date and Place of Publication Unknown.

F. Tinschert and D. Stoeckel, "Temperature Compensation with Thermovariable Rate Springs in Automatic Transmissions", 1991, Place of Publication Unknown.

*Primary Examiner*—David M. Purol

[57] ABSTRACT

A louvered window covering, such as a vertical or horizontal venetian blind, is provided with a thermal actuator to automatically rotate slats forming the louvered window covering between open and closed positions. The actuator includes at least one memory alloy spring that, when heated above a predetermined temperature, extends to engage and move a rack that drives a pinion gear. The pinion gear rotates, through a coupling mechanism, a rod extending the length of the blind. A second memory alloy spring may be installed to rotate the rod in the opposite direction. The rod intercouples the slats in a rewiner such that the rotation of the rod rotates the slats in unison between closed and open positions. The memory alloy spring may be heated with a current supplied to a controller in response to a predetermined environmental condition.

29 Claims, 3 Drawing Sheets

FIG. 2
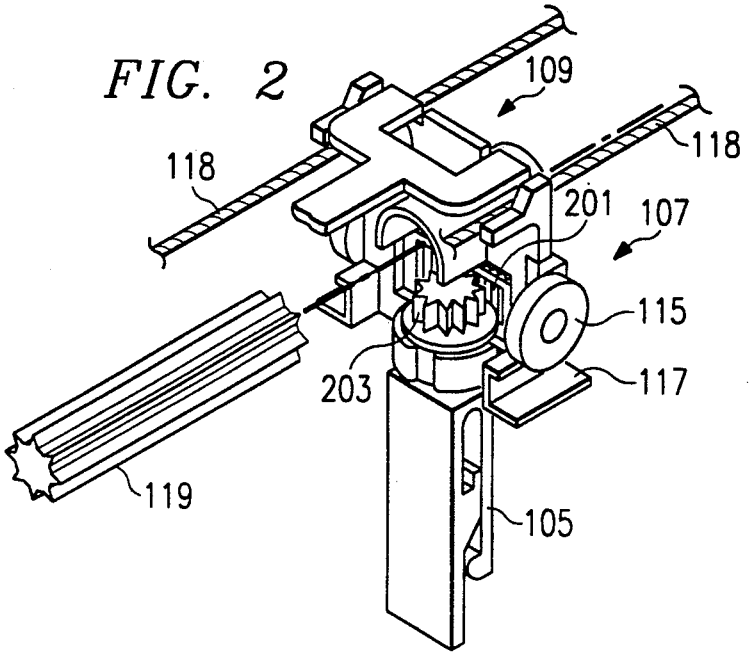
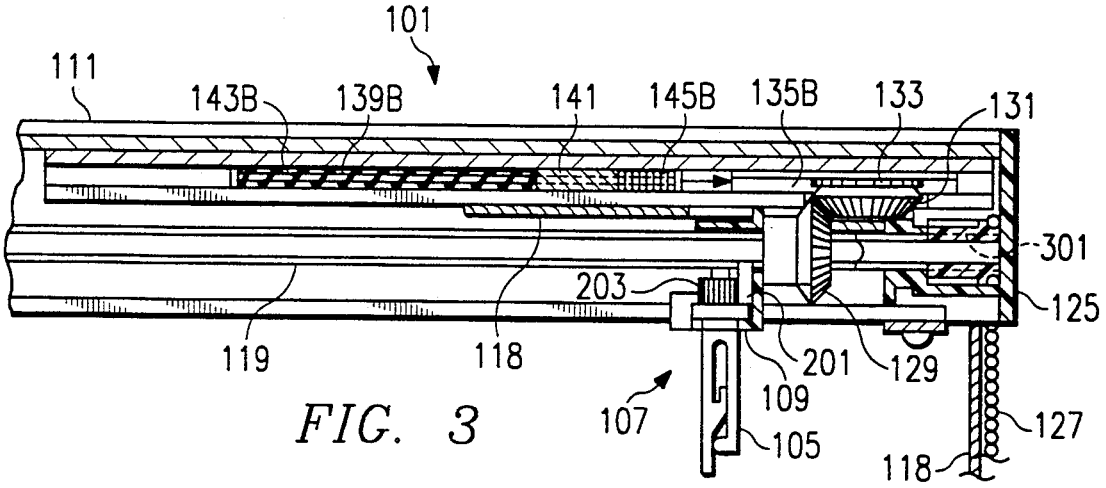
FIG. 3

ENVIRONMENTALLY INTERACTIVE AUTOMATIC CLOSING SYSTEM FOR BLINDS AND OTHER LOUVERED WINDOW COVERINGS

FIELD OF THE INVENTION

The invention relates generally to louvered coverings and more particularly to systems for automatically opening and closing window blinds.

BACKGROUND OF THE INVENTION

Louvered window coverings, such as venetian blinds, vertical blinds, shutters and other types of movable shades (generally referred to as "blinds"), are generally thought of as primarily providing privacy. However, significant heat is generated in enclosures by incident sunlight coming through windows. Because they regulate the amount of incident light within an enclosure, blinds thus play an important role in controlling the ambient temperature in the enclosure, and in conservation and efficient utilization of energy.

Most people prefer that the interior temperature of their homes remain at approximately 72 degrees Fahrenheit for optimal comfort. During the summer, for example, blinds may be closed to reduce heat and to save energy required for air conditioning to cool the air heated by light coming through the windows. During the winter, to take advantage of the heat generated by the light blinds may be opened during the day and closed at night to slow the loss of heat through the windows, thereby saving energy. As a significant amount of energy is consumed in heating and cooling enclosures, proper operation of blinds during the course of the seasons can materially contribute to energy conservation by its efficient utilization.

Blinds enhance security as well. When used on business premises, for example, blinds should be left open at night so that security personnel can peer through the windows. At home, however, the blinds should be closed.

Commercially available louvered window coverings are, with few exceptions, manually operated. Designers and manufactures know that successful blinds and shades should be of simple design for low cost, reliable operation and convenience of use, and simple designs are manually operated. To take full advantage of the benefits of movable or adjustable louvered window coverings, therefore, requires a vigilant person to operate the blinds, one who understands these benefits. As such circumstances are rare, so too are blinds rarely used to their fullest benefit and advantage. Blinds which automatically open and close are therefore desirable.

Despite the needs and desires for automatic systems, the industry still strongly favors the simple design of manual blinds. There have been attempts to automate operation of blinds, primarily for convenience of remote operation, though also to respond to changes in the environment, particularly the amount of light incident on the blinds. Previous attempts at automation have generally been, however, too costly and failed in terms of cost, reliability and adaptability to the wide variety of blind mechanisms.

The automation of blinds in the prior art has involved coupling the blind's positioning mechanism, typically a rod running the length of the blind that intercouples the slats of the blind for rotation in unison, to direct current (DC) motors or solenoids that generate the work necessary for opening and closing the blinds. They are also very noisy, making them less appealable. The motors hum, the solenoid actuator clicks, and the gears grind. Furthermore, DC motors and solenoids are relatively large and cumbersome. They often are not adaptable to some types of blind mechanisms. They also sometimes cannot be incorporated into the blind mechanism, but must be mounted either on a wall to pull a draw string, or to the outside of the housing for the blind mechanism. The latter case requires quite complex mechanical interfaces with the blind mechanisms, necessitating substantial and numerous types of modifications to the various types of preexisting blinds for retrofit, or special manufacture of blinds with the motors. Either way, simplicity is sacrificed and cost substantially increased.

The fact that DC motors and solenoids require a source of power for operation further increases cost and complexity. Each blind must be equipped with an AC to DC converter if power is taken from a wall socket. Otherwise, batteries must be used. Typically, they are expensive varieties, such as NiCad batteries, so that they do not have to be frequently replaced and may be recharged by expensive solar, photoelectric cells or circuitry to provide a constant trickle charge of current.

Moreover, to control the DC motors and solenoids during operation of the blind mechanism, relatively complex and expensive circuits must be used. These circuits are further complicated where the same circuit centrally controls several different types of blind mechanisms, as each mechanism potentially requires specialized operation of the DC motor or solenoids.

SUMMARY OF THE INVENTION

The invention recognizes these and other shortcomings of previous automatic blinds and overcomes them by employing a compact, thermal actuator easily fitted to standard commercial blinds, to create an automated system that is fully responsive to the environment without human intervention and materially contributes to conservation and efficient ufilization of energy.

The thermal actuator is a spring formed from a memory alloy that is coupled to a standard blind mechanism. The memory alloy has a first, relaxed (martensite) state or phase at ambient temperature and a second, fully-actuated (austenite) state or phase when heated to a predetermined temperature. When shaped into a spring, the transition of the memory alloy from the relaxed state to the fully-actuated state causes linear motion along the axis of the spring that is applied to a mechanigal interface coupling the spring to the blind mechanism that in turn actually rotates the slats of the blinds.

Because of its narrow profile and linear orientation, the memory alloy spring is easily fitted within housings, called rails sometimes, of standard blind positioning mechanisms or obscured along the backside of a rail. Thus, current blind designs may be continued to be used, with little added complexity or cost of manufacture, and pre-existing blinds easily retrofitted.

As the spring has a predetermined stroke, no control circuits are required to position the blinds. The spring and mechanical interface against which it acts are chosen to provide full linear movement of the spring to rotate the slats between open and closed positions.

In one embodiment, a passive configuration, no AC power adapters or batteries are required, thereby saving further space and reducing complexity of design. The memory alloy spring is chosen such that, when the ambient temperature is below a predetermined temperature it is in the relaxed, martensite state and the blinds are in an open position. When the ambient temperature reaches a preselected temperature, the spring extends by changing phases from its relaxed martensite state to its actuated austenite state, causing the slats of the blinds to rotate to a closed position. When the temperature falls back below a second predetermined temperature (the temperature response of the memory alloy has a hysteresis), the memory alloy spring relaxes. A steel biasing spring coupled to the blind mechanism rotates the slots to the open position.

In other embodiments, energy for the work of rotating the slats is supplied by a current which varies in response to external input. The current is run through the spring, which is highly resistive, thereby producing heat to warm the spring to the predetermined temperature.

The current may be supplied from an independent source, such as a solar cell. When the current from the solar cell exceeds a predetermined point in response to a certain amount or intensity of sunlight, the memory alloy spring is actuated to rotate the slats of the blinds either the open or closed position as required. Otherwise, the trickle current is supplied from a controller which is electrically connected to the spring. The controller may run current in the memory alloy spring in response to light, temperature sensors, timers, or to manually operated remote controls.

In accordance with another aspect of the invention, a second memory alloy spring may be added to respond to ambient temperature or be heated with a current, so as to rotate the slats in a direction opposite to that caused by the first spring. When added to the passive configuration, for example, a complementary second memory alloy spring having a higher temperature range permits opening and closing of the blinds at different temperature ranges. As another example, when the first memory alloy spring is controlled by a solar cell that opens the blinds in summer to let in sunshine, the complementary memory alloy spring may close the blinds when the ambient temperature reaches a predetermined temperature. Magnifying or fresnel lens may be employed to concentrate the sun or heat.

For fully versatile control, a pair of complementary memory alloy springs are used with a controller supplying current to heat the springs, one spring rotating the slats to an open position and the other rotating them to a closed position. The controller is programmed to balance the needs of the room for light, energy efficiency and security for any given time of day and day of the year, all without intervention of a person. The controller electronics may be mounted within the blind or externally.

Several other advantages are derived from the use of memory alloy springs as blind actuators. First, because they may be incorporated into a wide variety of blind mechanisms without substantial modification, blinds of different types throughout an entire building can be controlled from a central location without an increase in the complexity of the control. Each blind, no matter what type, is operated with the same control signal. Furthermore, memory alloy springs are capable of fine control, if desired, because of their predictable temperature versus displacement curve. By correlating power input to the spring with the displacement of the memory alloy spring, the slats may be finely positioned by controlling the current flowing through the spring to partially actuate the spring and partially moving the slats. This requires, however, a sensitive controller. Adding a feedback loop comprised of a simple variable resistor dependent on the position of the blind mechanism is a simple means of accomplishing the fine control. Moreover, the same fine positioning may be achieved without significantly increasing the complexity of the actuator in the blind mechanism.

The second memory alloy spring also removes the need to constantly trickle current through the first memory alloy spring to maintain it in an actuated austenite state, thereby removing unnecessary stress and preserving their life. It permits free, manual movement of the blind mechanism throughout its complete range of movement without interfering or disrupting the blind's automation. Moreover, this approach eliminates the need to use standard springs that are unreliable due to the fact that they degenerate with use.

In accordance with other aspects of the invention, a rack and pinion gear serves as a mechanical interface between the memory alloy spring and the blind mechanism's drive shaft, the spring controlling the position of the rack.

These and other aspects and advantages of the invention are shown in the following description of its preferred embodiment illustrated in the accompanying drawings.

BRIEF DESCRIPTION OF THE DRAWINGS

FIG. 2 is a detail perspective view of a blind rotating mechanism used in the blind positioning mechanism of FIG. 1.

FIG. 3 is a cross-section of FIG. 1, taken along section line 3—3.

DETAILED DESCRIPTION OF THE DRAWINGS

Figure 1:
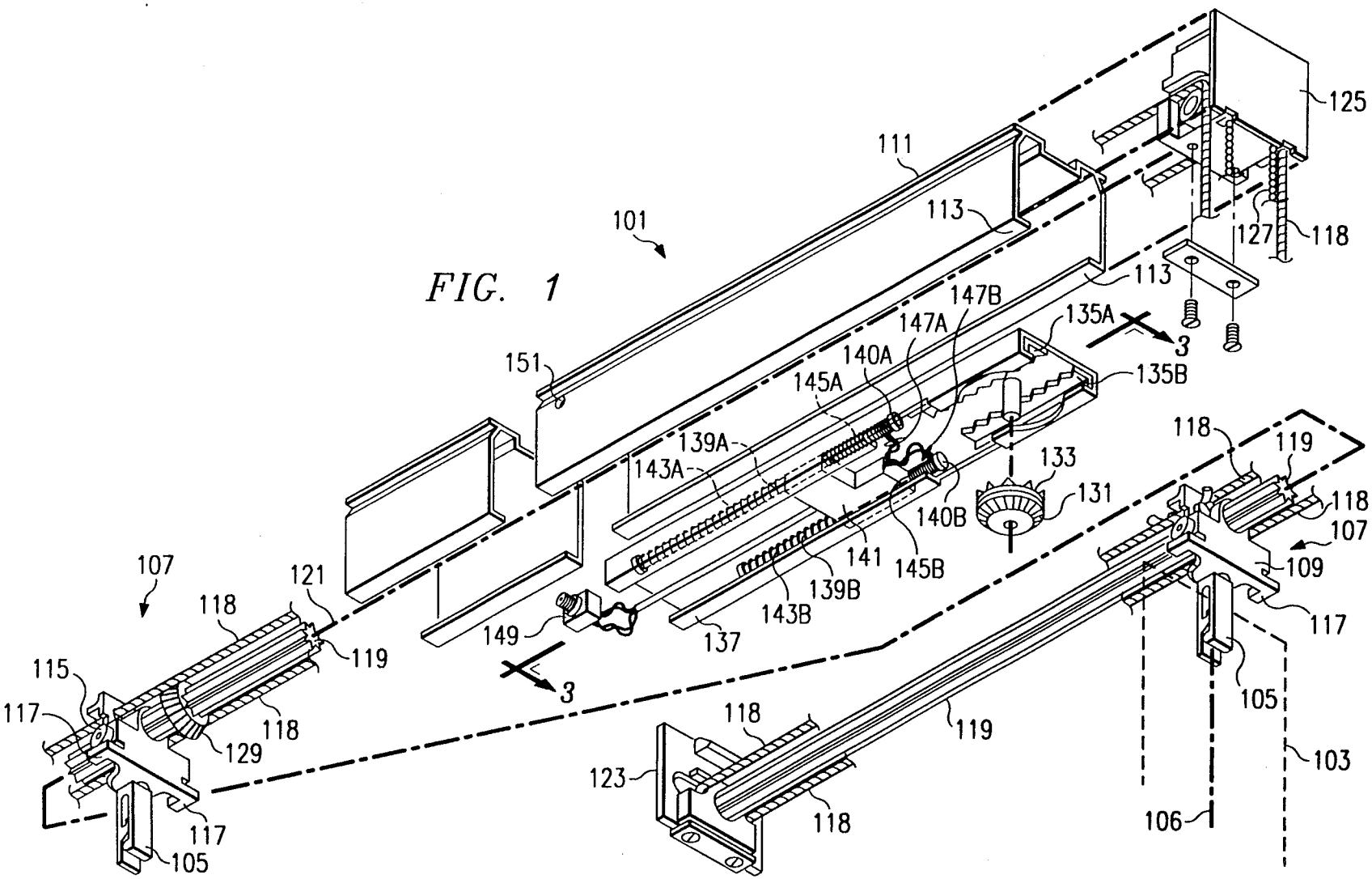
FIG. 1 is an exploded perspective view of a standard commercially available blind positioning mechanism, intended to be representative of blind mechanisms generally, fitted with a thermal actuator in accordance with the present invention.

Referring to FIG. 1, blind mechanism 101 is representative of standard, commercially available mechanisms for operating a vertical blind or louver with movable slats or fins. Each vertical slat 103 is hung from a clip 105. Clip 105 is, in turn, coupled for rotation about a vertical axis 106 running down through the middle of the slat to slat positioning mechanism 107. This permits rotation of the slats of the blind 180 degrees, between a closed position (0 and 180 degrees) and an open position (90 degrees). Each slat positioning mechanism 107 includes a support member 109 that slides translationally along the longitudinal length of enclosure 111, across an opening or window (not shown). Support member 109 includes wheels 115, each mounted on the side of support member 109, that roll along flange sections 113 of enclosure 111. To properly fix the orientation of support member 109 so that it freely moves within enclosure 111, the support member also includes two wing sections 117, one on each side, disposed on the bottom side of flange 113, opposite of the side engaged by wheels 115. Support member 109 is also sized to closely fit a cross-sectional profile of enclosure 111 and thereby further stabilize its orientation. Cord 118 is used to pull the slat positioning mechanisms 107 longitudinally across the window.

Referring now to FIGS. 1 and 3 together, to transmit motion to slats 103 and to synchronize their rotation, pinion shaft 1 19 extends horizontally along the length of the enclosure 111, across the window or opening, and is mounted within the enclosure for rotation about axis 121. One end of the pinion shaft 119 fits within defined within a plastic end cap 123. The other end of the pinion support cylinder is fitted within a sprocket-like coupling 301 (FIG. 3) rotatably fixed within cap 125 for coupling chain 127 to the shaft. Preferably, the gear ratio of the sprocket to the pinion shaft is one to one.

Referring now to FIGS. 2 and 3 for explanation of the interaction of pinion shaft 1 19 and slat positioning mechanisms 107, teeth on the pinion shaft 119 mesh with a top row of teeth on rack 201 that is mounted on support member 109 for movement transverse to the shaft. A second set of teeth on rack 201 engages pinion gear 203. Pinion gear 203 is connected to clip 105, the rotational axis of pinion gear 203 coinciding with the rotational axis 106 (FIG. 1) of the clip. Pulling chain 127 causes pinion shaft 119 to rotate, which in turn moves rack 201; and movement of rack 201 rotates pinion gear 203, which in turn rotates clip 105 and slat 103 (FIG. 1).

Referring back to FIGS. 1 and 3, automatic operation of the positions of the slats is achieved by fitting pinion shaft 119 with bevel gear 129, the position of which is secured with a set screw. When blind mechanism 101 is fully assembled, as shown in FIG. 3, bevel gear 129 meshes with bevel gear 131, which in turn is connected to pinion gear 133. Pinion gear 133 engages racks 135A and 135B, the racks being disposed on opposite sides of pinion gear 133. The racks 135A and 135B slide along rack carrier 137, which is an injection molded plastic having a low coefficient of friction. Pushing on one rack rotates slats in one direction, and pushing on the other rack rotates the slats in the opposite direction.

Each rack is pushed by one of two parallel rods 139A and 139B. Each rod moves translationally through a hole in a non-conducting support block 141. Placed between a head at one end of each rod and the support block 141 are biasing springs 143A and 143B that encircle rods 139A and 139B, respectively. The biasing springs are compressed so as to generate a force to keep the rods in a retracted position as shown.

On the other side of support block 141 are memory alloy springs 145A and 145B that work to extend the rods 139A and 139B. The memory alloy springs 145A and 145B are shaped from a memory alloy that includes nickel and titanium, known as "Tinel". Their spring rates are determined by the shear modulus of the material, which, in turn, changes with the temperature as a result of a reversible martensite to austenite solid state phase transformation. The spring rate is comparatively low when "cold" and high when "warm". When cold, the rate of the memory alloy springs is too small to overcome the opposing force applied to the rods by the biasing springs. However, when warmed, the spring rates increase, overcoming the biasing forces to extend the rods. The maximum length to which the memory alloy springs extend is termed the shape set length.

Each rod 139A and 139B linearly displaces one of the two racks 135A and 135B when extended. Displacement of one of the racks rotates pinion gear 133 in one direction, and displacement of the other rack rotates the pinion gear 133 in the opposite direction. Rotation of the pinion gear 133 rotates bevel gear 131. Rod 139A is longer than rod 139B and has a stroke that is twice the length of the stroke of rod 139B. To fully extend rod 139A, memory alloy spring 145A has twice the shape set length as memory alloy spring 145B. The longer stroke of rod 139A ensures that, no matter what position the slats of the blind are in, they are rotated to a closed position when rod 139A is fully extended. The stroke of rod 139B is determined so that, when fully extend, the slats are turned 90 degrees to the fully opened position.

When the temperature falls, the memory alloy springs relax and are compressed by the rods with biasing forces applied by bias springs 143A and 143B. Heads 140A and 140B of rods 139A and 139B are offset from the racks 135A and 135B when the memory alloy springs are fully relaxed and the rods are fully retracted by biasing springs 143A and 143B. The distance by which the rods are offset is at least equal to the full travel distance of the racks in each of the slats closed positions. With this offset, the slats may be manually rotated without interference from the rods trying to position the racks. To accommodate memory alloy spring 145A, having the longer shape set length, support block 141 is formed in an "L" shape. A square block, however, could be used but the racks were have to be made with uneven lengths.

The actual temperatures at which the memory alloy springs 145A and 145B transition can be chosen over a wide range of temperatures. However, each alloy displays a temperature hysteresis effect between its austenite and martensite states. In the martensite state, the spring remains relaxed below the martensite state start temperature. The spring linearly extends, when constantly weighted, its temperature rise above the martensite start temperature, until it reaches the martensite finish temperature. The transition in the austenite state is, however, displaced to a greater temperature. The temperature at which the springs begin to relax in the austenite state is greater than the martensite finish temperature; and the austenite finish temperature, the temperature at which the memory alloy spring is relaxed, is greater than the martensite start temperature. The hysteresis depends on the type of Tinel used. Two types of Tinel memory alloys are preferred. One is Alloy 49-51; the other is a very new alloy, generically referred to as "R-phased transition alloy". Alloy 49-51 has a hysteresis of approximately 15 degrees centigrade. R-phased Transition Alloy has a tight hysteresis of approximately 2 degrees centigrade. The hysteresis prevents shuddering of the blinds when the temperatures of the springs are within the transition region.

To heat the Tinel springs 145A and 145B, ambient temperature may be relied on, or an electrical voltage may be applied across each spring, causing it to conduct current. Conductor wire pairs 147A and 147B, one wire in a pair being connected to each end of the spring, provide the current from a controller (not shown) that is plugged into socket 149 extending through hole 151 in enclosure 111. Due to the relatively high resistivity of the Tinel alloy, the springs heat rather rapidly. The springs are coated with an insulating plastic to provide electrical resistance. Furthermore, to facilitate attaching the wires to the springs, the ends of springs are shaped into a straight length. Otherwise, connection to a curvilinear section would cause the connection to loosen.

The memory alloy springs are easily adaptable to work with a wide variety of blind mechanisms. Most blinds include some sort of rotating member, or drive shaft, that runs the length of the blind to simultaneously rotate the blind slats. Examples of these include, without limitation: a vertical blind mechanism that uses a rod to rotate a worm gear that, in turn, drives a rack to pivot the vertical slats; or horizontal blind mechanisms that use a rod in cooperation with a string mechanism to rotate the slats. A rack and pinion mechanical interface, similar to that described, may be used to couple the memory alloy springs to the rotating rod. However, it is possible that a blind mechanism that utilizes translationally moving member instead of a rod to intercouple the blind may be used to drive the pivoting of the slats of the blind in unison. In this case, the linear movement of the memory alloy springs may be coupled to the blind mechanism without use of any rotating members, using for example just a rack or some other linearly moving interface.

Furthermore, to accommodate different blinds, memory alloy springs may be coupled in parallel or in series to increase force and/or stroke as required. Also, the helical memory alloy springs may be stretched, instead of compressed, in the martensitic phase so that the spring contracts instead of extends when heat is applied. Moreover, the springs need not necessarily be helical. Dual opposing, torsion springs about the blind's drive shaft may also be used. A length of wire formed from a memory alloy material can also function as a spring. For example, a Tinel wire that is placed about two pulleys of different diameters acts as spring when the smaller pulley is a heat source and the larger pulley is a heat sink. Applying heat to the smaller pulley causes the wire to rotate the pulleys, thereby creating work which can be used to rotate the blinds.

Figure 4:
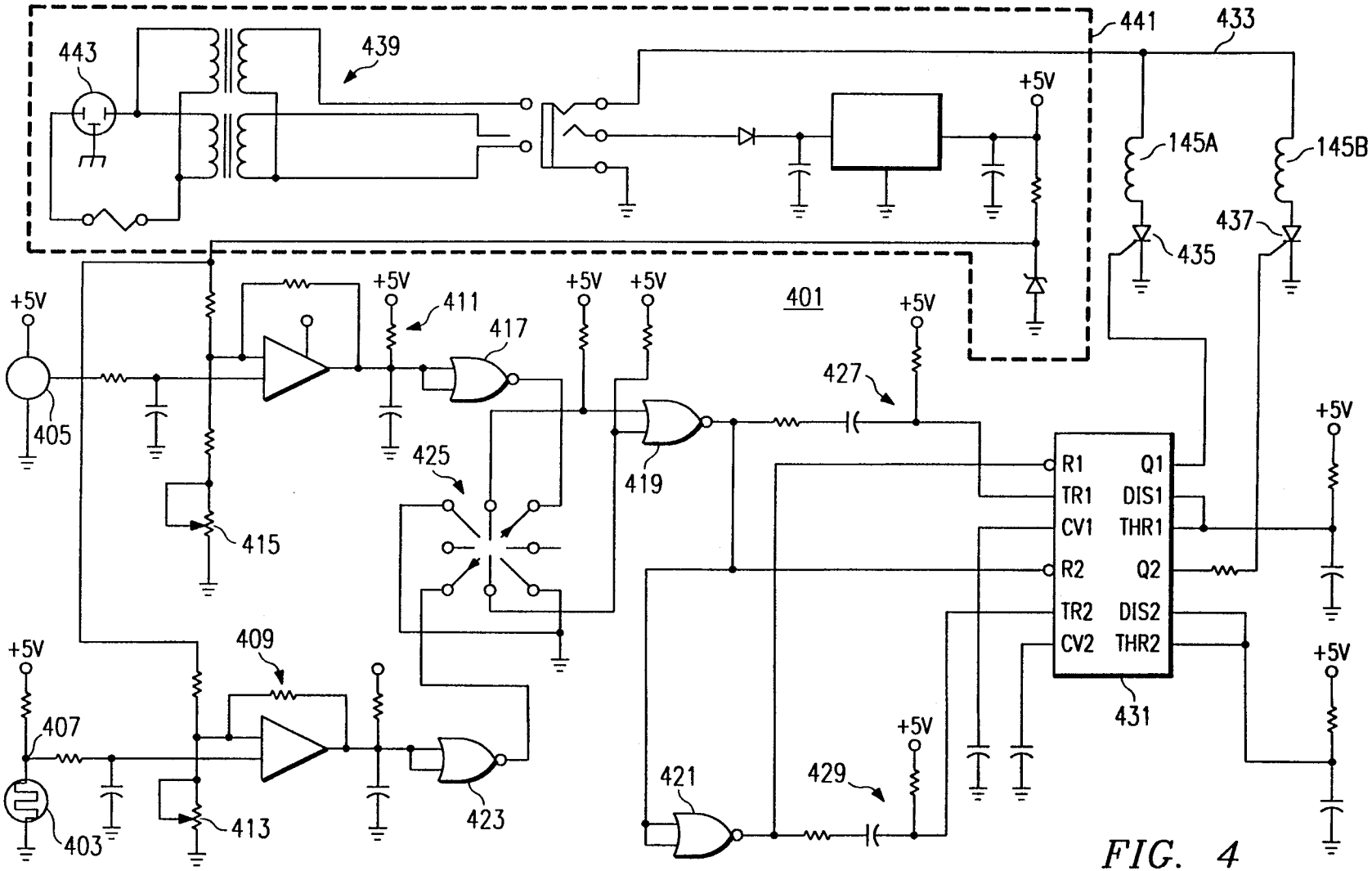
FIG. 4 is a schematic diagram of a remote electronic controller that is shown coupled to two memory alloy springs used in the blind positioning mechanism shown in FIG. 1, the controller automatically causing opening and closing of the blinds in response to ambient light and temperature conditions.

Referring now to FIG. 4, controller 401 generates the currents to heat the memory alloy springs 145A and 145B (FIG. 2) in response to comparisons between sensed ambient light and temperature conditions and user selected light and temperature thresholds. The controller may be either remotely installed, and used, with minor modifications to control a plurality of blinds and may be integrated into the blind mechanism itself, if desired. Light conditions are sensed with light sensor 403, such as a cadmium sulfide photoresistor, and temperature sensor 405, such a National Semiconductor LM35DZ. A resistively scaled voltage of the photoresistor at input 407 that is inversely related to the light level is provided to the inverting input of analog voltage comparator circuit 409. Similarly, the voltage generated by the temperature sensor 405, which is proportionally related to the temperature level, is provided to analog voltage comparator circuit 411.

The output voltages of the sensors are compared to voltages set by a user with potentiometer 413 (for the light) and 415 (for the temperature) to correspond to desired light and temperature conditions. The input and output relationship of each voltage comparator circuit 409 and 411 is hysteresis-like. This prevents spurious oscillations in the output voltage of the comparator circuits when the temperature and light conditions are near the threshold values.

The outputs of the voltage comparator circuits 409 and 41 1 are coupled to logic circuitry that includes four NOR gates 417, 419, 421, 423 and double-pole switch 425. The function of switch 425 is to turn the light and temperature sensors "on" and "off" by connecting and disconnecting the outputs of the voltage comparator circuits 409 and 411 to the logic circuitry. The logic circuitry determines, in response to the outputs of the voltage comparatory circuits, whether the blinds should be opened or closed, according to the following criteria.

When the ambient light level is or falls below the light level set by the user, the blinds are closed, regardless of the temperature. This keeps the blinds closed at night for purposes of privacy. When the ambient temperature is or rises above the preset temperature, the blinds are also closed to help the environment remain cool or cool down efficiently. Otherwise, when the ambient light is brighter than the light threshold and the temperature less than the temperature threshold, the blinds are opened.

To implement this logic, the four NOR gates are used as follows. The logic NOR gates 417 and 423 simply act as inverters, inverting the output of the voltage comparator circuits 411 and 409, respectively. One input of NOR gate 419 is coupled to the inverted output of voltage comparator circuit 411 (for temperature) and the other input is coupled to the inverted output of voltage comparator circuit 409 (for light). The output of NOR gate 419 is connected to the two inputs of NOR gate 421, this NOR gate thus acting as an inverter, as well as to differentiator circuit 427 and a second time reset input R2 of dual timer integrated circuit (LM556) 431. The output of NOR gate 421 is connected to differentiator circuit 429 and to the first timer reset input R1 of timer circuit 431. The outputs of the differentiator circuits 427 and 429 are connected to the trigger inputs, TR1 and TR2, respectively, for the first and second timers on integrated timer circuit 431.

Upon transition of the light level to above its preset threshold when the temperature is already below its preset threshold, or upon the transition of the temperature to below the threshold when the light level is already above its threshold, the output of NOR gate 419 transitions from a high to a low, causing the differentiator circuit 427 to trigger the first timer and NOR gate 421 to reset the second timer. Upon transition of the output of NOR gate 419 from low to high, as caused by the temperature rising above its threshold or the light falling below its threshold, the output of NOR gate 419 resets the second timer before the output of differentiator circuit 429 triggers the second timer.

The output of each timer, Q1 for first timer and Q2 for the second timer, is connected to the control inputs of silicon rectifiers 435 and 437, respectively. Triacs may be substituted for the silicon controlled rectifiers. A current supply line taken off a second tap of a step down transformer's 439 secondary winding in AC power supply 441, which is at 4 volts AC, is electrically coupled, in the manner shown in FIG. 1, to one end of each of the memory alloy springs 145A and 145B (FIG. 1) mounted in the blind positioning mechanism 101 (FIG. 1). The other end of springs 145A and 145B is coupled separately to the silicon controlled rectifiers 435 and 437. The silicon controlled rectifiers act as switches, closing the circuit to permit current to flow through the memory alloy springs to heat them. The current has an AC average to approximately 2 amperes. The Tinel wire comprising the memory alloy springs has a nominal resistance of 1 ohm. As the heating of the memory alloy spring is equal to the product of the current squared and the resistance, dissipating four watts or 20 joules which is sufficient to heat each memory alloy spring past the martensite finish temperature, requires current to flow for approximately forty seconds. Therefore, the timers of timing circuit 431 are set for forty seconds, which provides sufficient heating of the memory alloy springs to change states and fully extend.

AC power supply 441 includes a step down transformer 439 connected to an AC power signal source 443. One tap of the transformer is connected to voltage regulator integrated circuit 445 to provide five volts of power to the logic and comparator circuits.

Other embodiments include using in place of timing circuit 431 and the logic circuitry a programmable microprocessor or microcontroller. The microprocessor receives inputs from the environmental sensors, either from the voltage comparator circuits or from an analog to digital converter, and sends control signals to the silicon controlled rectifiers to open and close the current. A digital computer may be used to control the blinds of an entire building, if desired, and to work in conjunction with heating, ventilation and air conditioning systems and security systems to optimize energy use and security. If a DC power supply is used in place of AC power supply 441, the silicon controlled rectifiers would be replaced with transistors.

The invention has been described in its preferred embodiments for purposes of illustrating and explaining the invention. This detailed description should not be construed as limiting the invention to the embodiment set forth. Modifications may be made to the preferred embodiments without departing from the spirit and scope of the invention as defined and set forth by the appended claims.

What is claimed is:

1. A louvered window covering having automatic operation for closing and opening its louvers comprising:

a window covering having a plurality of movable slats;

a shaft intercoupling the slats for rotation in unison from a first position to a second position;

a first mitered gear coupled to said shaft;

a second mitered gear coupled to said first mitered gear;

a pinion gear coupled to said second mitered gear;

a rack operatively coupled to said pinion gear;

a memory alloy spring positioned parallel to said shaft and operatively positioned with respect to said rack, the memory allow spring extending when its temperature exceeds a predetermined temperature, thereby causing a force to be applied to the slats through said rack, said pinion gear, second mitered gear, said first mitered gear and said shaft to rotate the slats from the first to the second position.

2. The louvered window covering of claim 1 further including a rod extending through the memory alloy spring and offset from said rack whereby the rod is laterally displaced in a first direction, by the extension of the memory alloy spring, to contact and laterally displace said rack.

3. The louvered window covering of claim 2 further including a biasing spring through which the rod extends, the biasing spring laterally displacing the rod in a second direction, opposite the first direction, to remove said rod from contact with said rack when the memory alloy spring is not extended.

4. The louvered window covering of claim 1 further including a controller, the controller supplying a current through the memory alloy spring to cause the spring to heat and extend.

5. The louvered window covering of claim 4 wherein the controller includes a sensor responsive to an environmental condition, the controller supplying the current to the memory alloy spring in response to the sensor sensing a predetermined environmental condition.

6. The louvered window covering of claim 5 wherein the sensor is a light sensor.

7. The louvered window covering of claim 5 wherein the sensor is a temperature sensor.

8. The louvered window covering of claim 4 wherein the controller includes a timing means, the controller issuing a current at a predetermined time.

9. A louvered window covering having automatic operation for closing and opening its louvers comprising:

a window covering having a plurality of movable slats, the slats coupled for rotation in unison;

a first memory alloy spring mechanically coupled to the slats to rotate the slats from a first to a second position; the memory alloy spring extending when its temperature exceeds a predetermined temperature, thereby causing a force to be applied to the slats to rotate the slats from the first to the second position; and a second memory alloy spring mechanically coupled to the slats; the second memory alloy spring extending when its temperature exceeds the predetermined temperature, thereby causing a force to be applied to the slats to rotate the slats in a direction opposite than that of the first memory alloy spring.

10. The louvered window covering of claim 9 further including a first rod coupled to the first memory alloy spring for lateral movement with extension of the first memory alloy spring and a second rod coupled to the second memory alloy spring for lateral movement with the extension of the second memory alloy spring; the first rod coupled to the slats for rotating the slats in a first direction when the first rod is laterally displaced by extension of the first memory alloy spring, and the second rod coupled to the slats for rotating the slats in a second direction opposite the first direction when the second rod is laterally displaced by extension of the second memory alloy spring.

11. The louvered window covering of claim 9 further comprising:

first and second racks, the first memory alloy spring, when extending, moving the first rack and the second memory alloy spring, when extending, moving the second rack;

a pinion gear, the first and second racks meshing with the pinion gear with extension of the first memory alloy spring rotating the pinion gear in a first direction and extension of the second memory alloy spring rotating the pinion gear in a second direction opposite the first direction; and a shaft intercoupling the slats for rotation in unison, the pinion gear coupled to the shaft for rotating the shaft.

12. The louvered window covering of claim 9 wherein the first memory alloy spring extends in response to an ambient temperature greater than a first predetermined temperature, causing the slats to rotate to a closed position for blocking the transmission of heat and light.

13. The louvered window covering of claim 9 wherein the second alloy spring extends in response to an ambient temperature less than a first predetermined temperature to cause the slats to rotate to an open position for transmitting light therethrough and an acceptable level of associated heat.

14. The louvered window covering of claim 9 further comprising a current source for supplying a current through the first memory alloy spring to cause the spring to heat an extend.

15. The louvered window covering of claim 14 further including a sensor responsive to an environmental condition, the sensor coupled to the current source for causing, in response to a predetermined environmental condition, the current source to conduct current through the first memory alloy spring for heating the first memory alloy spring.

16. The louvered window covering of claim 9 further comprising a controller coupled to an environmental sensor; the controller having a first current output coupled to the first memory alloy spring and a second current output coupled to the second memory alloy spring; the controller causing current to flow through the first memory alloy spring to heat the first memory alloys spring in response to a first environmental condition sensed by the environmental sensor, and causing current to flow through the second memory alloy spring in response to a second environmental condition sensed by the environmental sensor.

17. The louvered window covering of claim 9 further comprising a current source for supplying a current through the second memory alloy spring to cause the second memory alloy spring to heat and extend.

18. The louvered window covering of claim 17 further including a sensor responsive to an environmental condition, the sensor coupled to the current source for causing, in response to a predetermined environmental condition, the current source to conduct current through the second memory alloy spring for heating the second memory alloy spring.

19. An actuator for fitting inside a housing of a blind, the blind having rotating slats forming louvers which regulate an amount of light passing through the blind, the slats intercoupled for rotation in unison, the actuator comprising:

a first memory alloy spring for mounting within a housing of a blind, the first memory alloy spring changing phase when above a predetermined temperature and extending linearly a first predetermined distance in a first predetermined direction;

a second memory alloy spring for mounting within the housing of the blind, the second memory alloy spring changing phase when above a predetermined temperature and extending linearly a second predetermined distance in a second predetermined direction;

a mechanical interface for mounting within the housing of the blind that couples the first memory alloy spring and the second memory alloy spring to intercoupled slats in the blind;

the first memory alloy spring positioned with respect to the mechanical interface such that the first memory alloy spring engages the mechanical interface when the first memory alloy spring extends in the first predetermined direction, thereby applying a linear force for the first predetermined distance to the mechanical interface and causing the mechanical interface to translate the linear force to a rotationally driving force for rotating, in a first direction, the intercoupled slats of the blind by a first predetermined amount;

the second memory alloy spring positioned with respect to the mechanical interface such that the second memory alloy spring engages the mechanical interface when the second memory alloy spring extends in the second predetermined direction, thereby applying a linear force for the second predetermined distance to the mechanical interface and causing the mechanical interface to translate the linear force to a rotationaly driving force for rotating, in a second direction which is opposite to the first direction, the intercoupled slats of the blind by a second predetermined amount.

20. The actuator of claim 19 further including an electrical current source coupled to the first memory alloy spring, the current source responding to a predetermined environmental condition to conduct a heating current through the first memory alloy spring, thereby causing the first memory alloy spring to extend.

21. The actuator of claim 20 wherein the electrical current source responds to an amount of ambient light.

22. The actuator of claim 20 wherein the electrical current source is coupled to an ambient temperature sensor, the electrical current source responding to a predetermined temperature by conducting current to extend the first memory alloy spring for rotating the slats to a predetermined position.

23. The actuator of claim 19 wherein the mechanical interface is comprised of a first rack for receiving the linear force of the first memory alloy spring and a pinion gear meshed with the first rack for translating the linear force to a rotational movement for rotating a shaft intercoupling the slats.

24. The actuator of claim 23 wherein the first memory alloy spring is integrally mounted with the first rack and the pinion gear on a base for insertion in the blind housing.

25. The actuator of claim 19 further including an electrical current source coupled to the second memory alloy spring, the current source responding to a predetermined environmental condition to conduct a heating current through the second memory alloy spring, thereby causing the second memory alloy spring to extend.

26. The actuator of claim 25 wherein the electrical current source responds to an amount of ambient light.

27. The actuator of claim 25 wherein the electrical current source is coupled to an ambient temperature sensor, the electrical current source responding to a predetermined temperature by conducting current to extend the second memory alloy spring for rotating the slats to a predetermined position.

28. The actuactor of claim 19 wherein the mechanical interface is comprised of a second rack for receiving the linear force of the second memory alloy spring and a pinion gear meshed with the second rack for translating the linear force to a rotational movement for rotating a shaft intercoupling the slats.

29. The actuator of claim 28 wherein the second memory alloy spring is integrally mounted with the second rack and the pinion gear on a base for insertion in the blind housing.

* * * * *